US008133158B2

(12) United States Patent
An

(10) Patent No.: US 8,133,158 B2
(45) Date of Patent: Mar. 13, 2012

(54) HANDGRIP

(76) Inventor: Tae Jin An, Incheon (KR)

( * ) Notice: Subject to any disclaimer, the term of this patent is extended or adjusted under 35 U.S.C. 154(b) by 5 days.

(21) Appl. No.: 12/675,781

(22) PCT Filed: Aug. 27, 2008

(86) PCT No.: PCT/KR2008/005012

§ 371 (c)(1),
(2), (4) Date: Feb. 28, 2010

(87) PCT Pub. No.: WO2009/028864

PCT Pub. Date: Mar. 5, 2009

(65) Prior Publication Data

US 2010/0255956 A1 Oct. 7, 2010

(30) Foreign Application Priority Data

Aug. 31, 2007 (KR) ..... 10-2007-0088318
Jul. 10, 2008 (KR) ..... 10-2008-0067122

(51) Int. Cl.
*A63B 21/00* (2006.01)

(52) U.S. Cl. ..... 482/49; 482/44

(58) Field of Classification Search ..... 482/44, 482/49, 45, 127
See application file for complete search history.

(56) References Cited

U.S. PATENT DOCUMENTS 3,075,769 A * 1/1963 Cunningham ..... 473/511
4,856,498 A * 8/1989 Osbon ..... 600/38
6,881,177 B2 4/2005 An

FOREIGN PATENT DOCUMENTS

KR 20-0273271 4/2002
KR 10-0625851 9/2006
KR 10-2006-0116774 11/2006

OTHER PUBLICATIONS

International Search Report mailed Feb. 26, 2009.

* cited by examiner

*Primary Examiner* — Jerome W Donnelly
(74) *Attorney, Agent, or Firm* — Christopher Paul Mitchell

(57) ABSTRACT

Provided is a handgrip including first and second operating arms that are spaced apart from each other; first and second link arms that are sequentially and obliquely disposed between the first and second operating arms, and of which both ends are rotatably connected to the operating arms, respectively, through rotating shafts; and a spring member that is installed to provide an elastic force biasing the first and second operating arms apart from each other.

8 Claims, 16 Drawing Sheets

[Fig. 1]
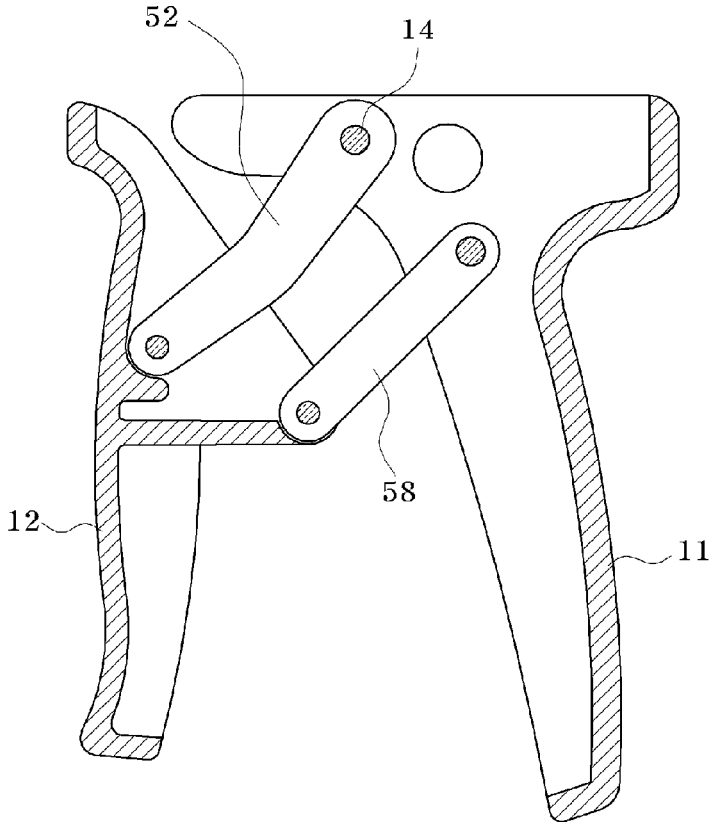
[Fig. 2]
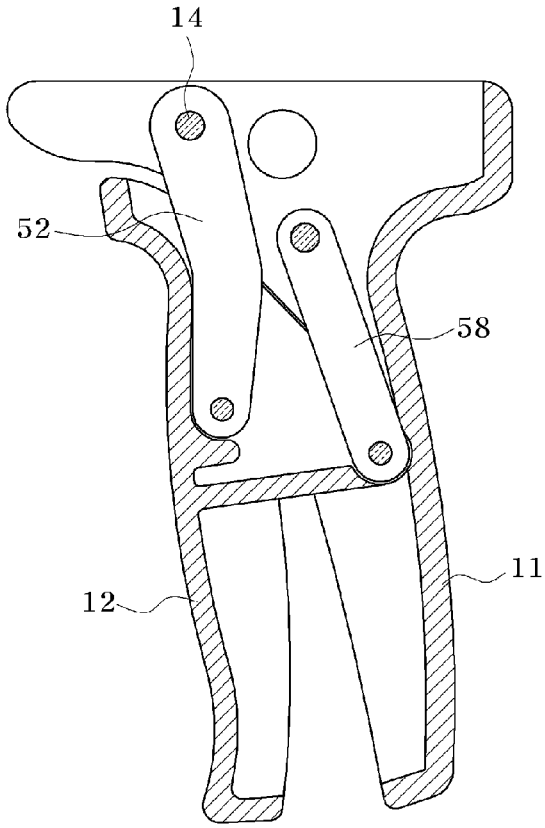

[Fig. 3]
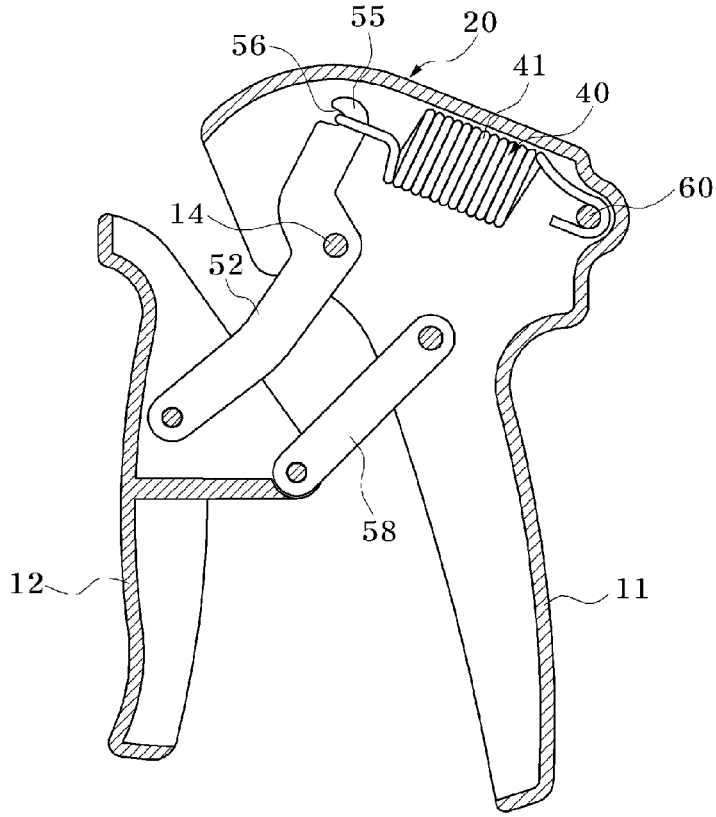
[Fig. 4]
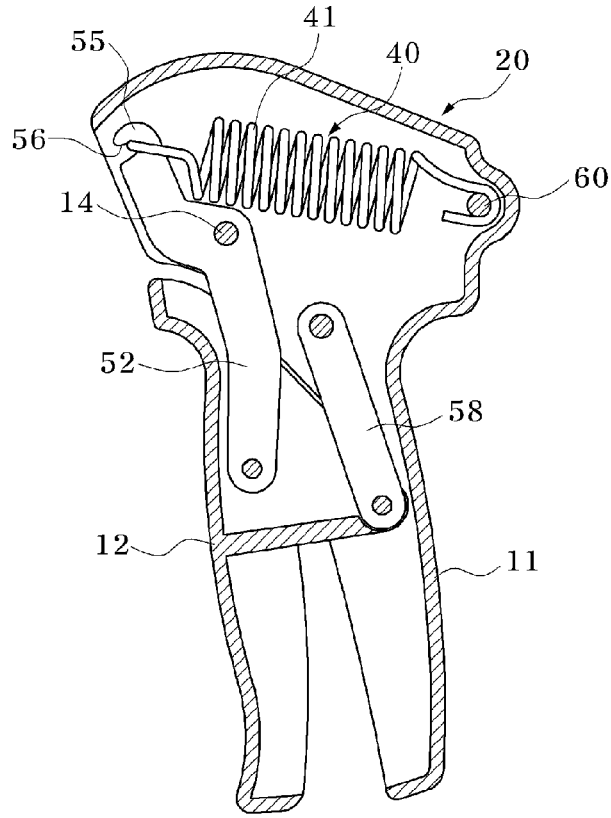

[Fig. 5]
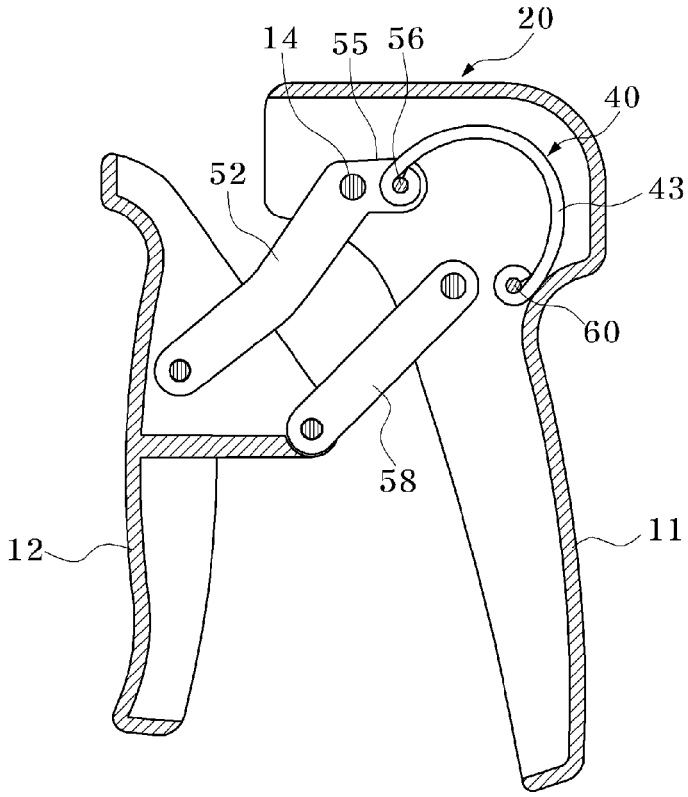
[Fig. 6]
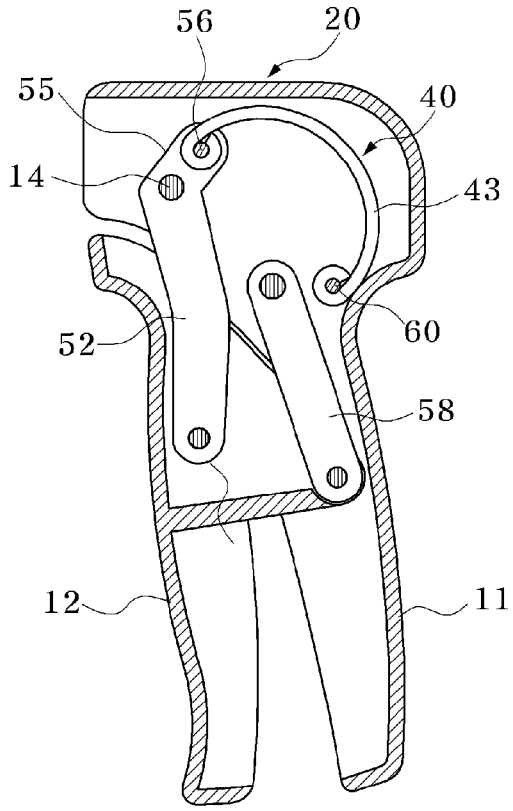

[Fig. 7]
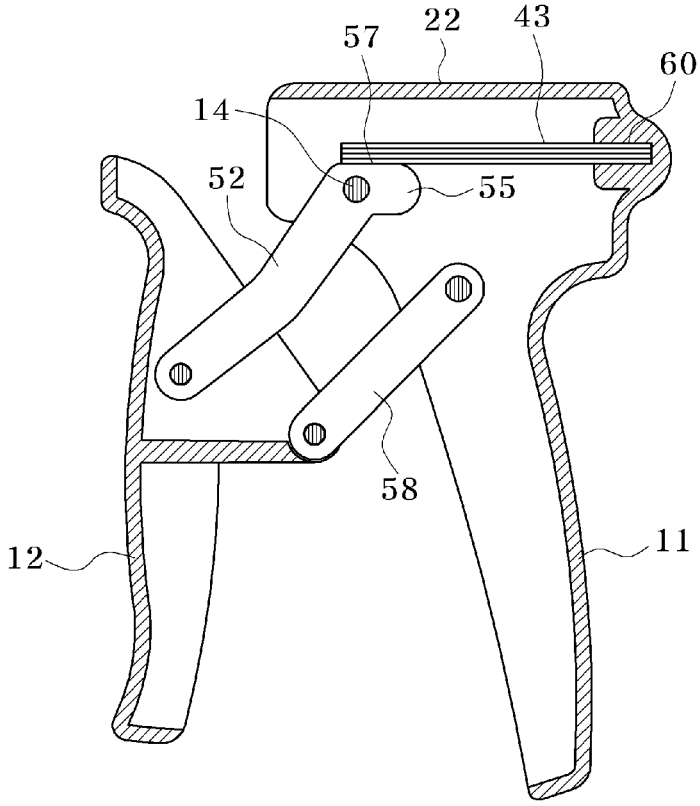
[Fig. 8]
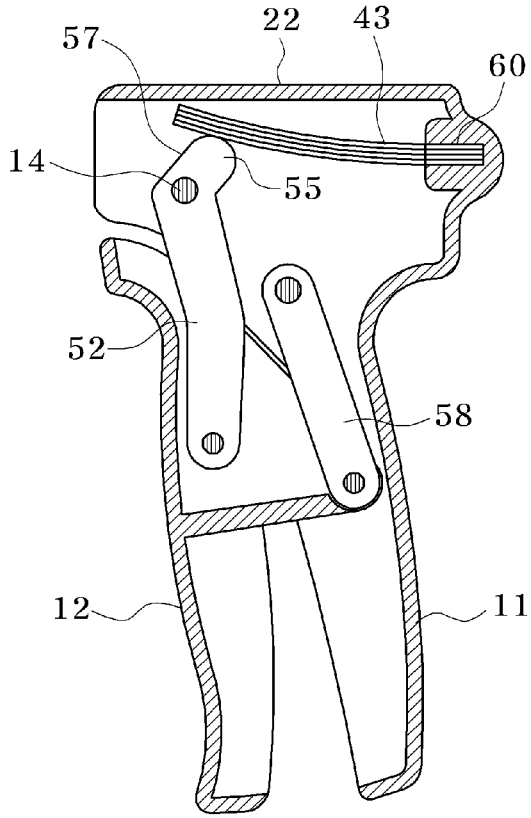

[Fig. 9]
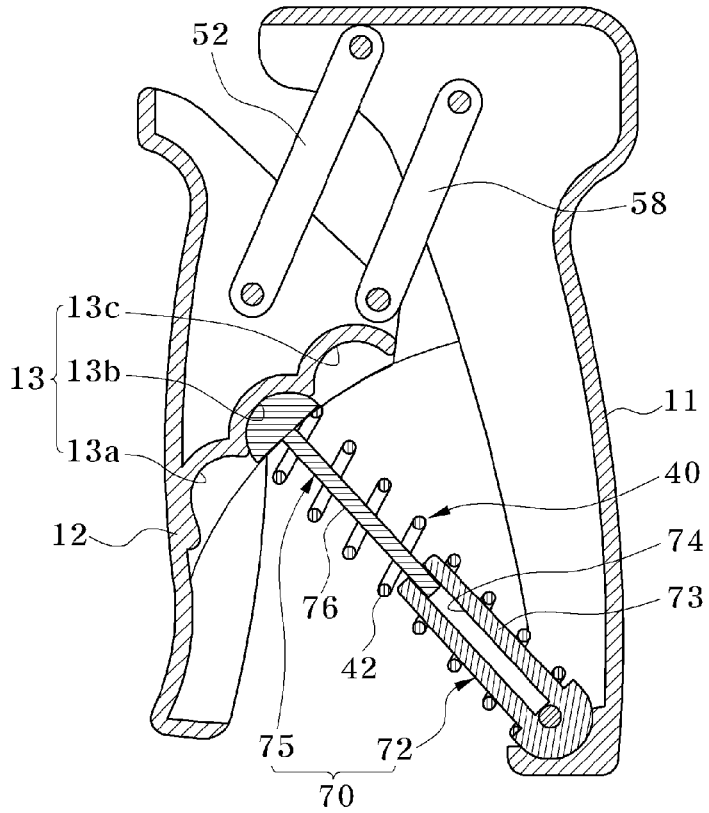
[Fig. 10]
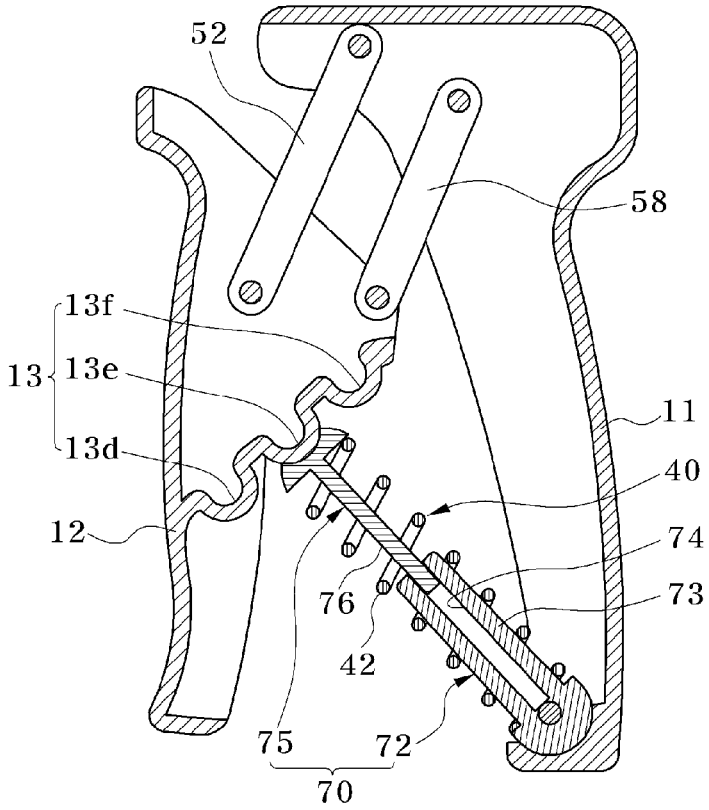

[Fig. 11]
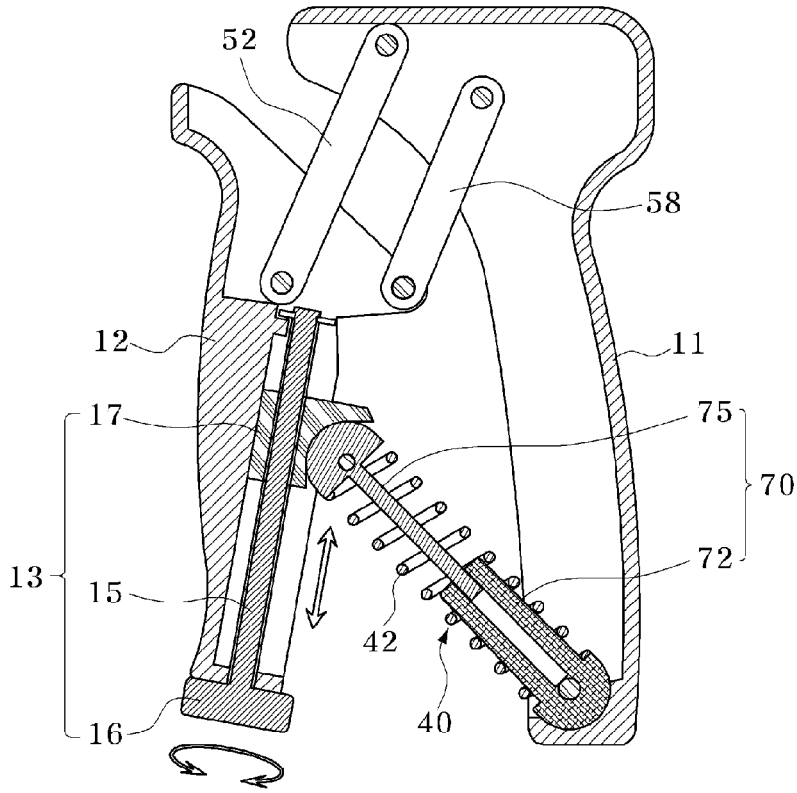
[Fig. 12]
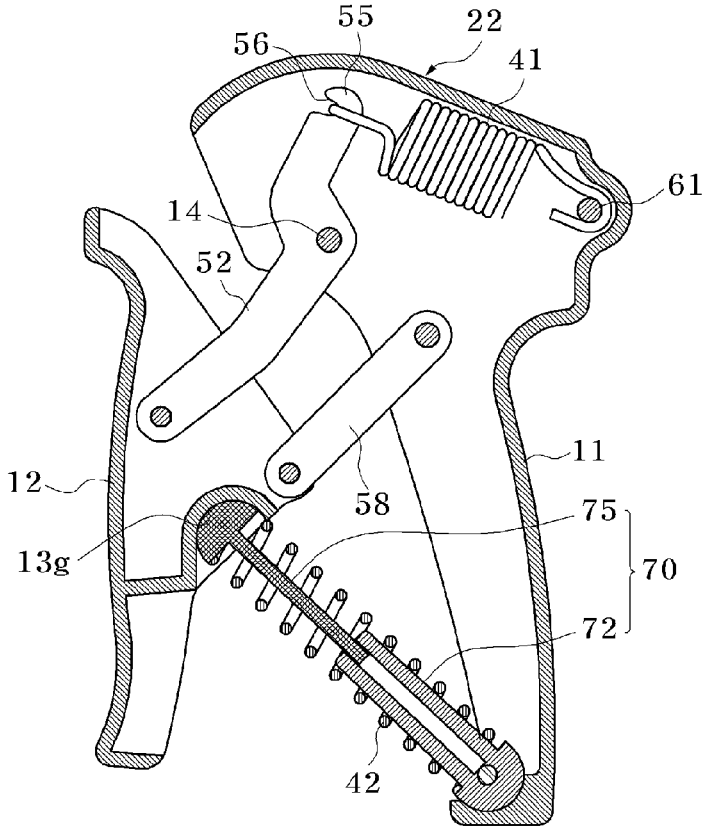

[Fig. 13]
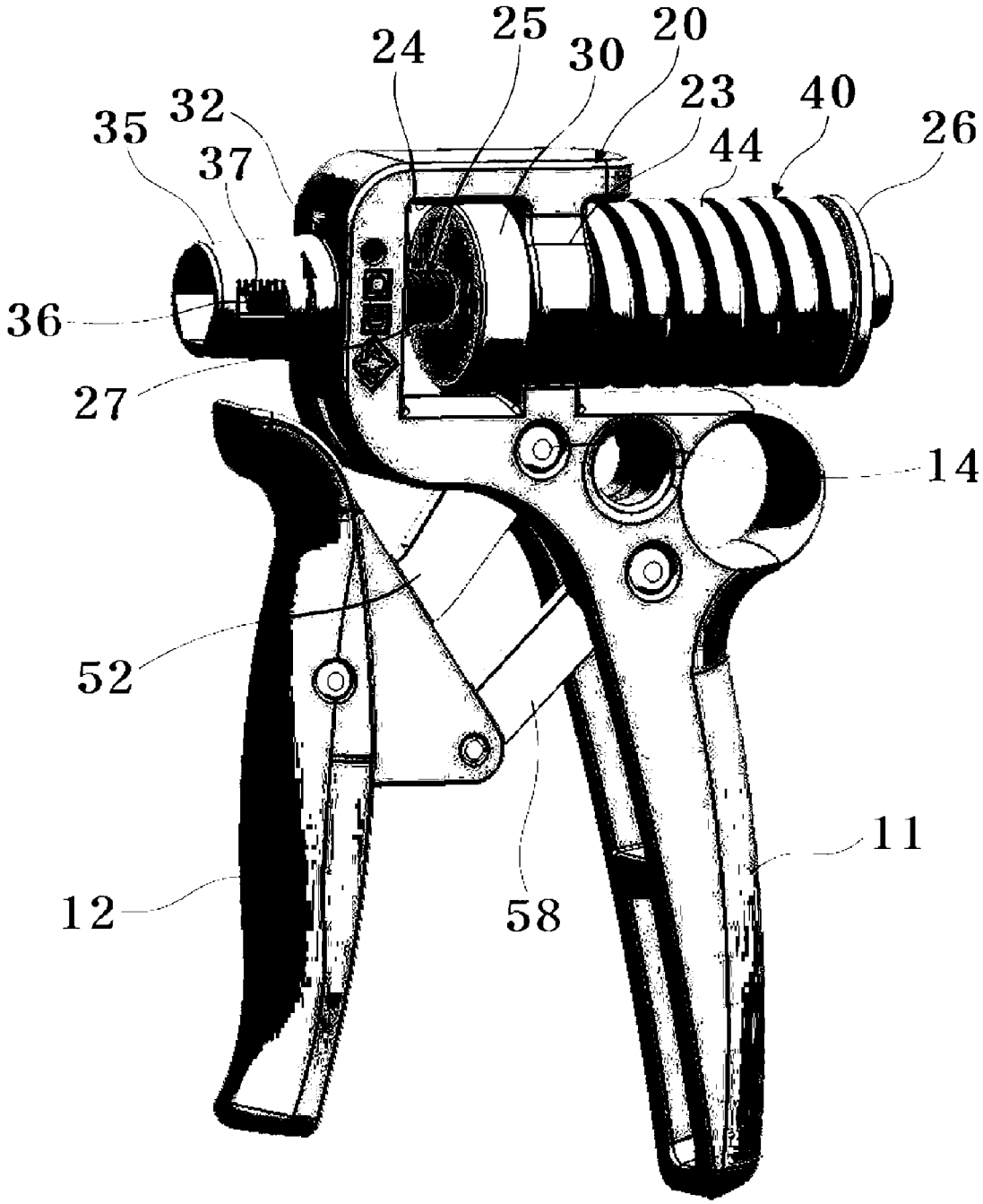

[Fig. 14]
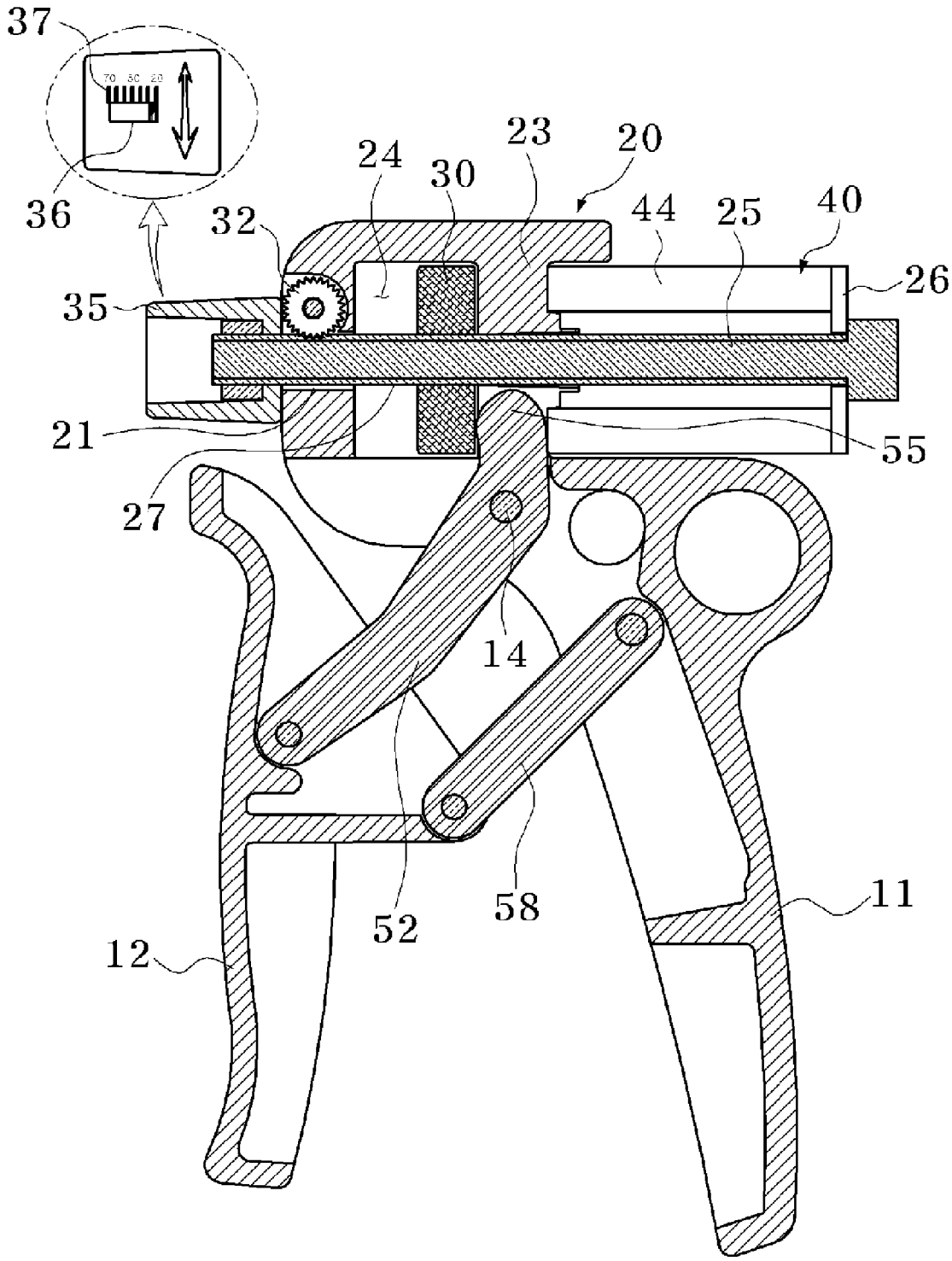

[Fig. 15]
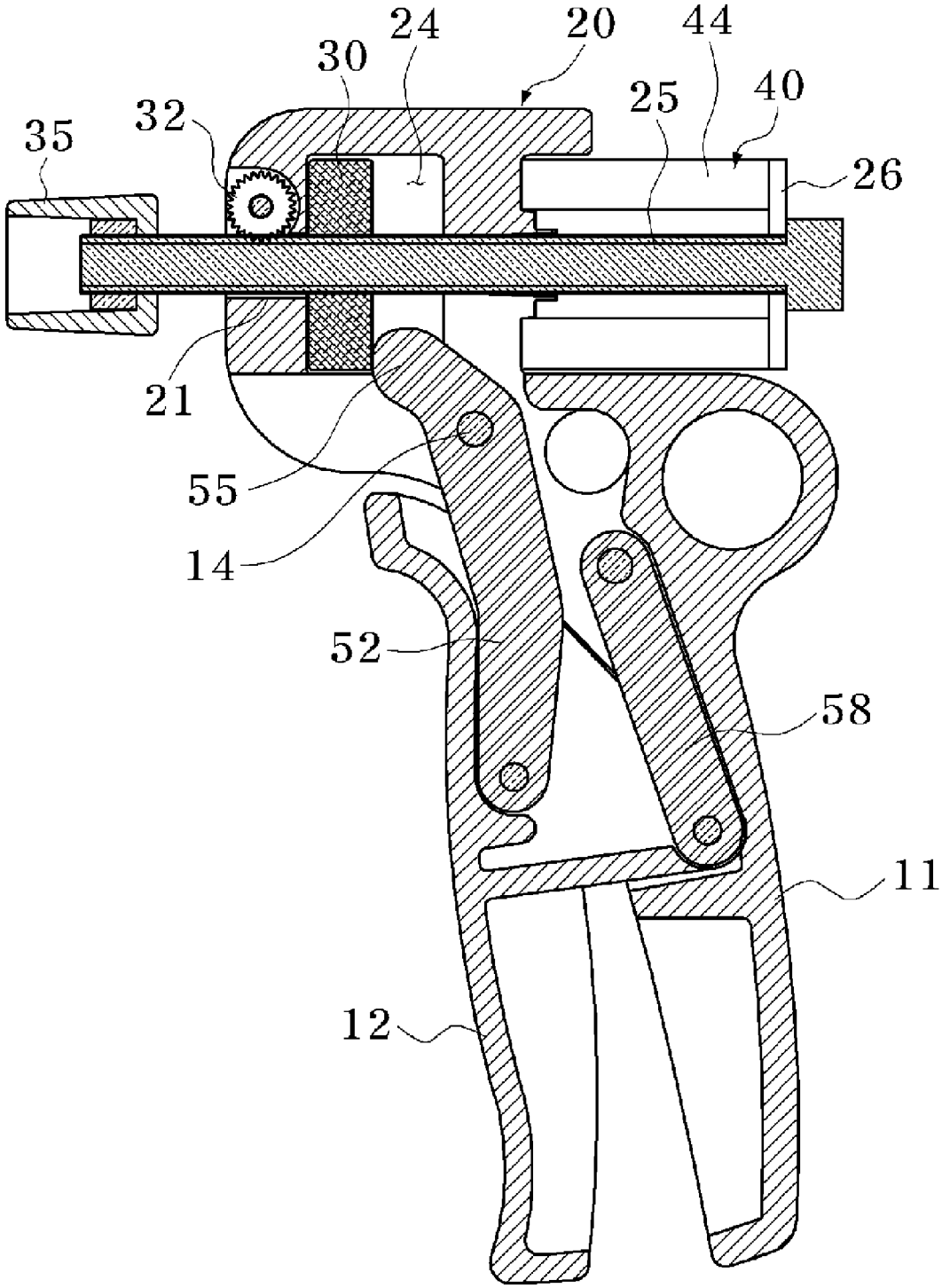

[Fig. 16]
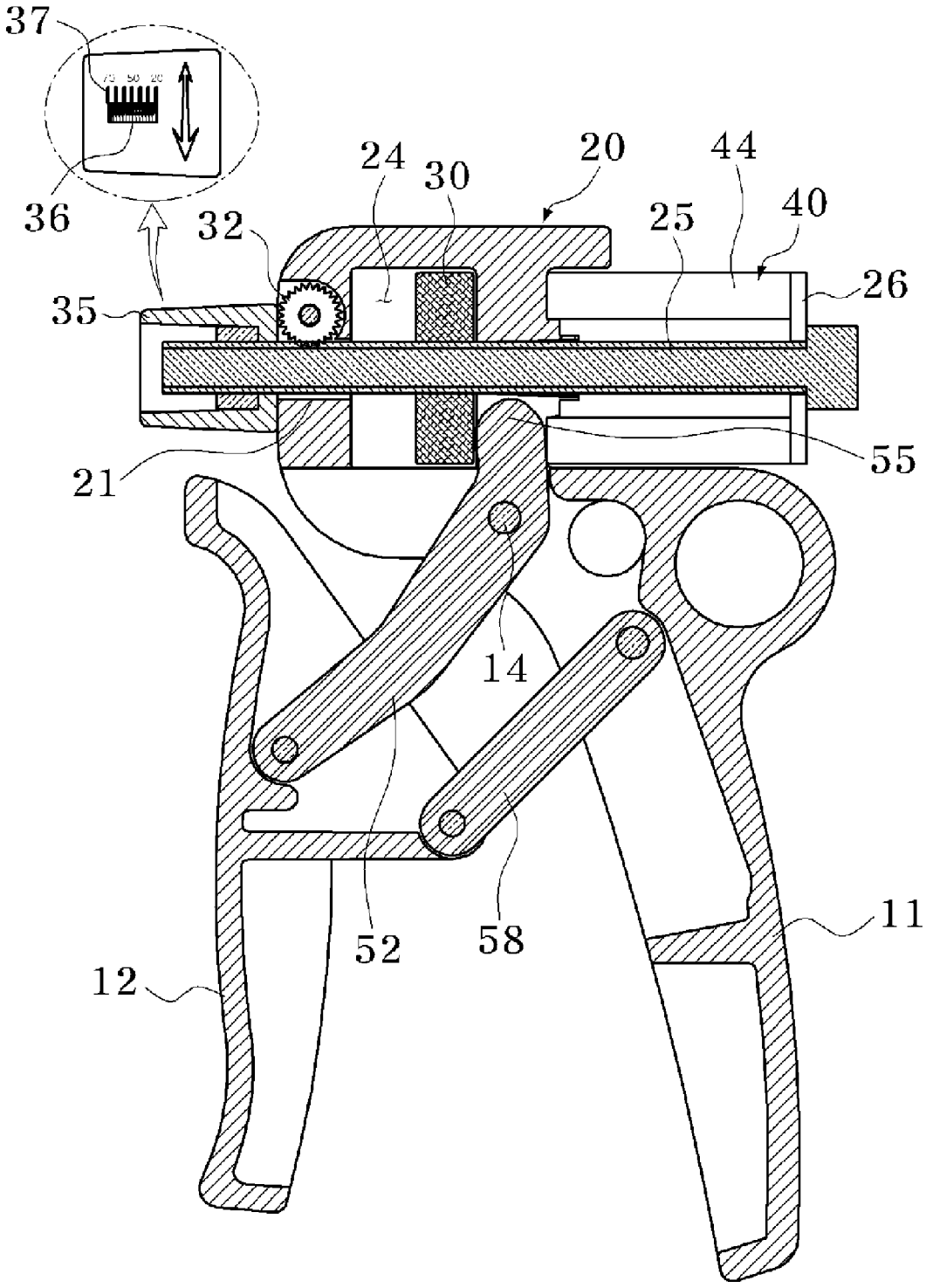

[Fig. 17]
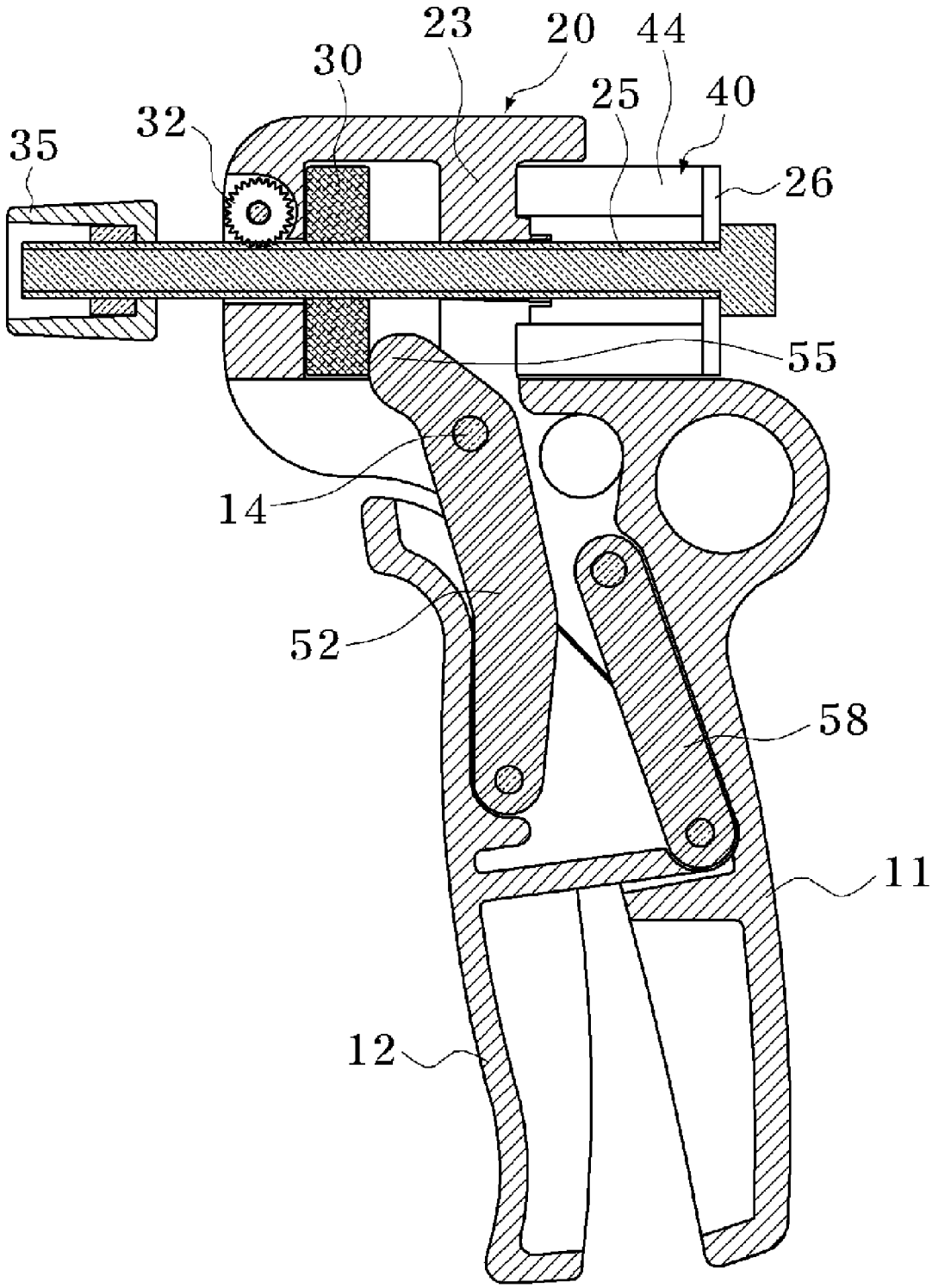

[Fig. 18]
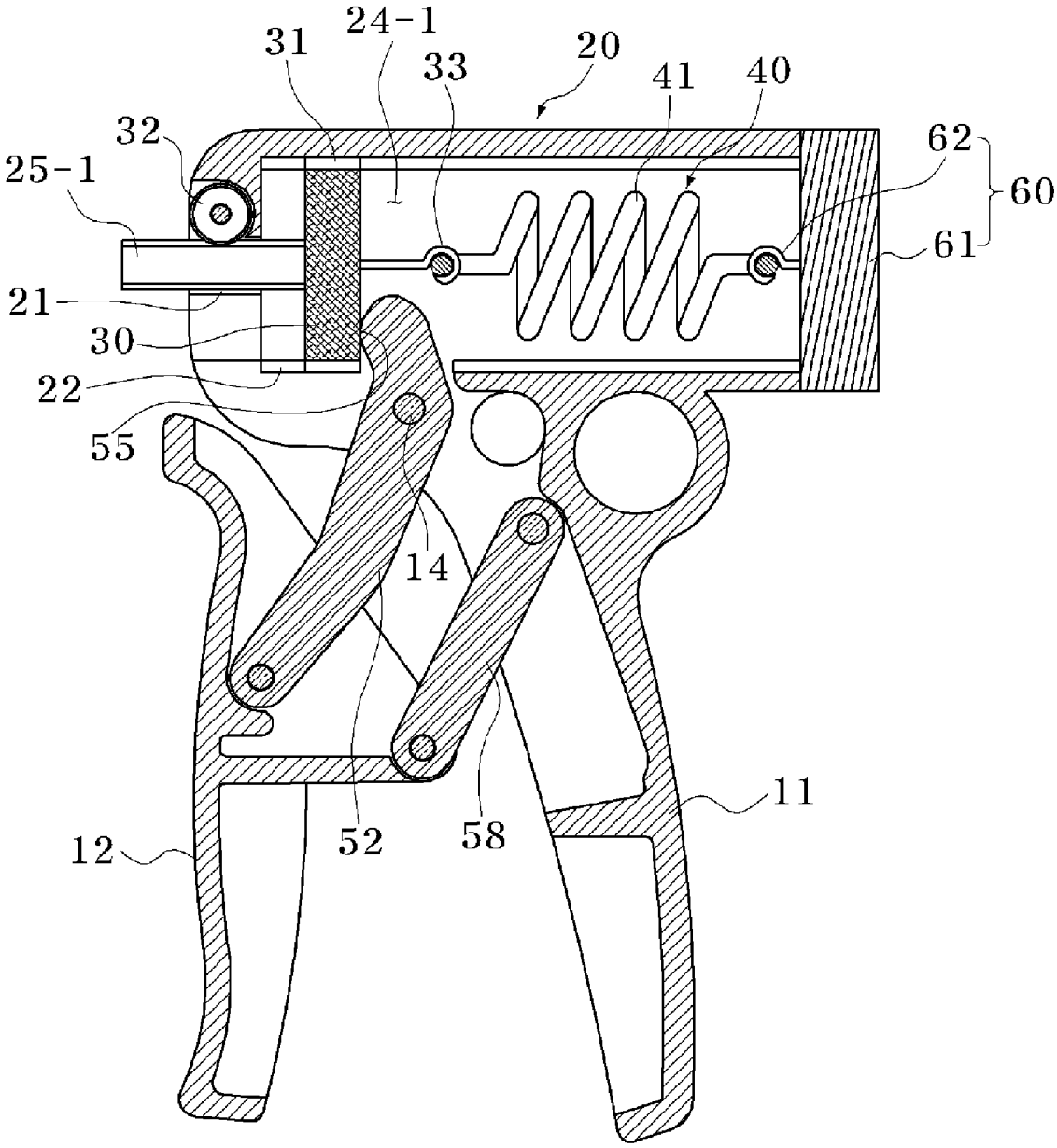

[Fig. 19]
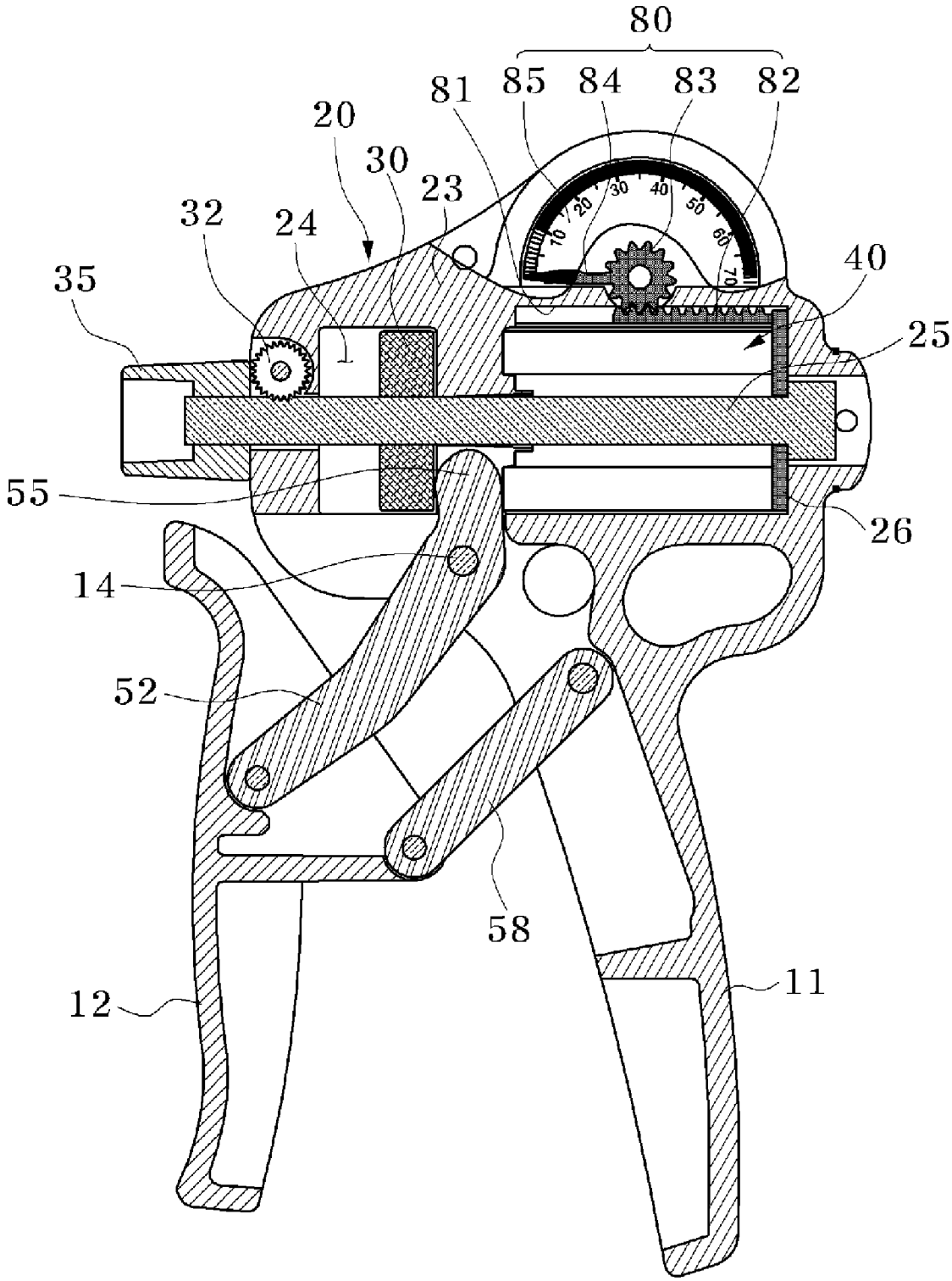

[Fig. 20]
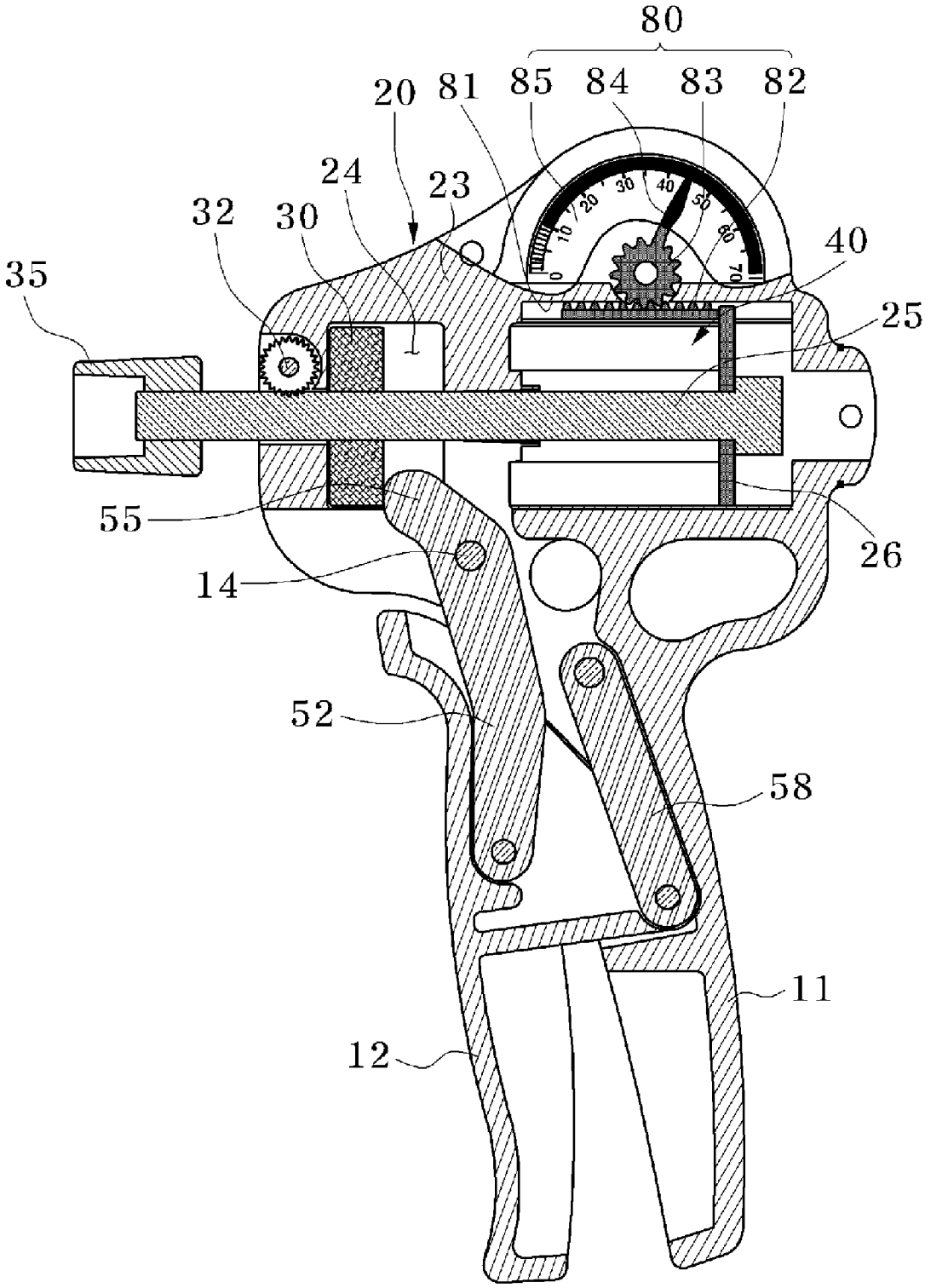

[Fig. 21]
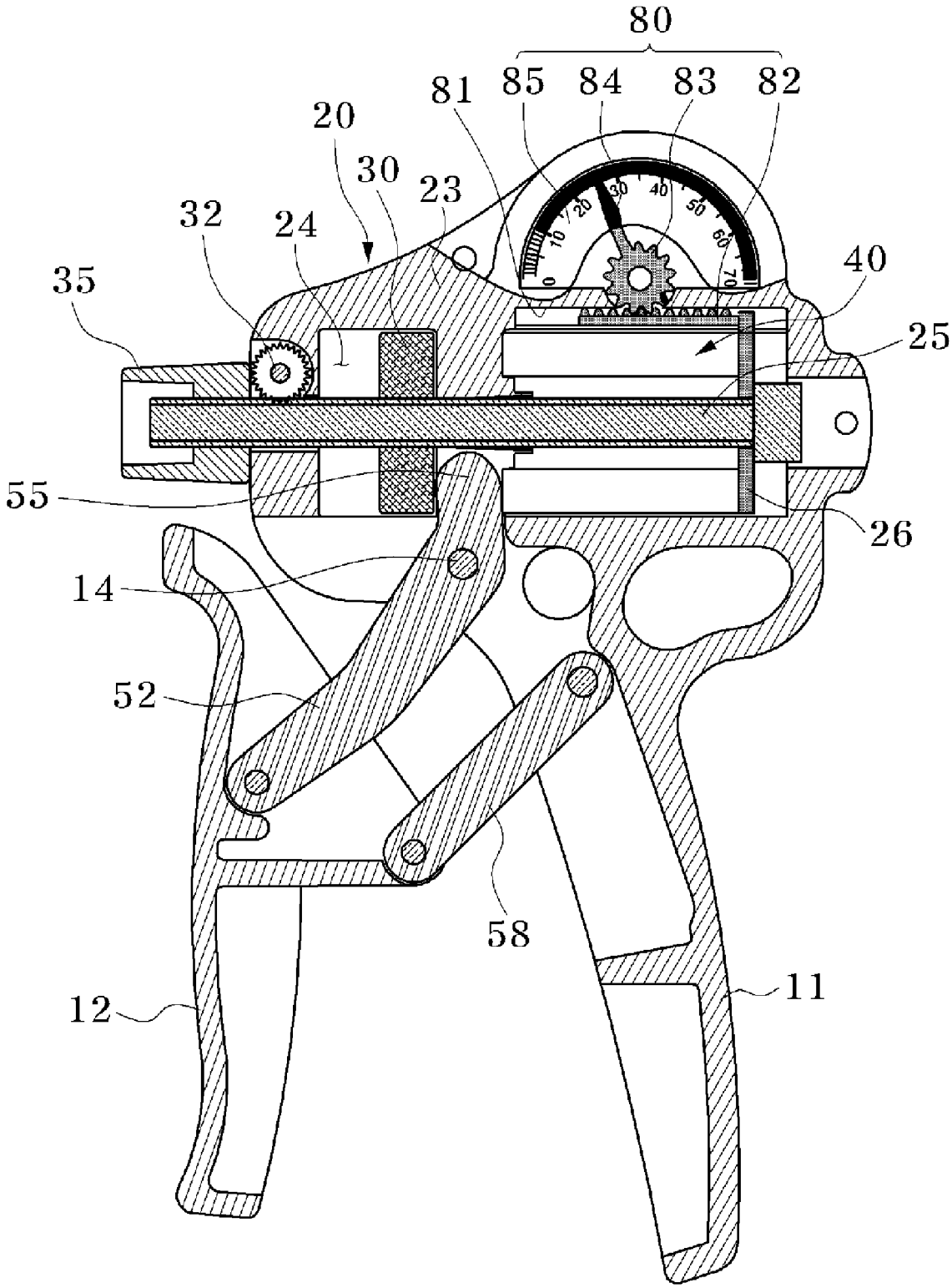

[Fig. 22]
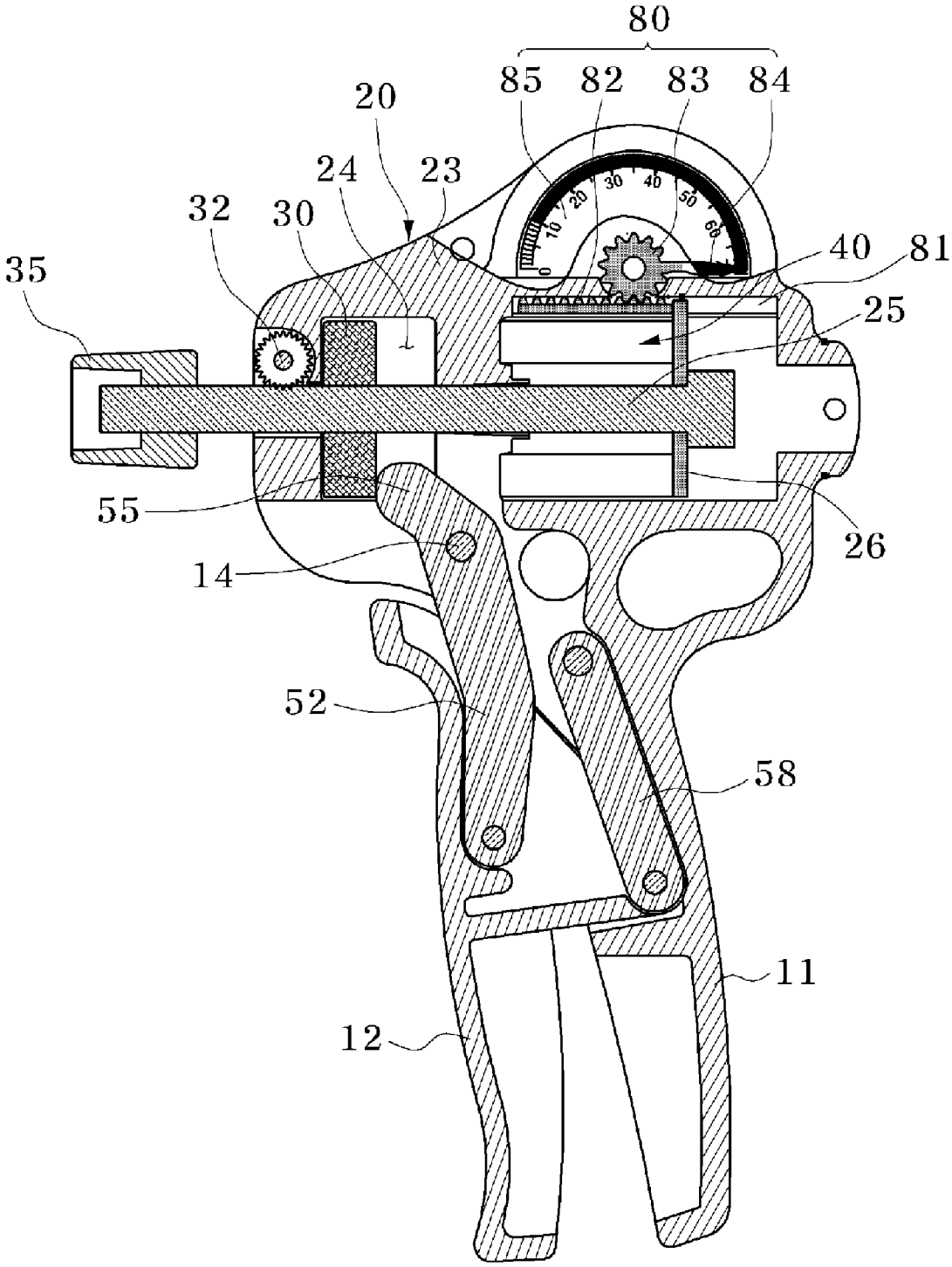

HANDGRIP

RELATED APPLICATIONS

This application is a 371 application of International Application No. PCT/KR2008/005012, filed Aug. 27, 2008, which in turn claims priority from Korean Patent Application Nos. 10-2007-0088318, filed Aug. 31, 2007, and 10-2008-0067122, file Jul. 10, 2008, all of which are incorporated herein by reference in their entireties.

TECHNICAL FIELD

The present invention relates to a handgrip, and more specifically, to a handgrip which provides an elastic force in a direction opposite to a direction in which two operating arms approach each other, so that a user can perform strength training.

BACKGROUND ART

A handgrip is a kind of exerciser used for improving the muscular strength of the hand and forearm of a user. Since the handgrip is easy to carry, men and women of all ages can easily use the handgrip anywhere and anytime.

A user grips a pair of operating arms of the handgrip, and then repeatedly squeezes and releases the operating arms. That is, as the user repeatedly applies a force which can overcome an elastic force provided by a spring, the muscular force of the user s hand and arm is improved.

A conventional handgrip has been disclosed and includes a pair of operating arms which are coupled to each other so as to rotate about a hinge point, and a spring member which is installed on or under the hinge point.

In the conventional handgrip, however, the movement of the operating arms is a rotational movement performed about the hinge point. Therefore, force may not be uniformly distributed across the palm of the user's hand when the user performs strength training. Further, since the installation position of the spring member is limited, there are difficulties in changing the size and strength of the spring member.

DISCLOSURE OF INVENTION

Technical Problem

The present invention is directed to a handgrip in which two operating arms are connected through two link arms and are capable of moving toward and away from each other in a state in which one operating arm is maintained substantially parallel to the other operating arm during grip training.

The present invention is also directed to a handgrip in which the design of a spring member can be easily changed.

Technical Solution

According to an aspect of the present invention, a handgrip includes first and second operating arms that are spaced apart from each other; first and second link arms that are sequentially and obliquely disposed between the first and second operating arms, and of which both ends are rotatably connected to the operating arms, respectively, through rotating shafts; and a spring member that is installed to provide an elastic force biasing the first and second operating arms apart from each other.

The hand grip may further include a body portion that is provided at the top of the first operating arm and has the spring member installed therein. One end of the spring member may be fixed to a spring fixing portion formed in the body portion, the other end thereof may be supported by a spring operating portion which operates while supporting the other end, thereby deforming the spring member, and the first link arm may be operationally connected to the spring operating portion such that when the first link arm is rotated about a rotating shaft as a connection portion between the first operating arm and the first link arm by movement of the operating arms toward each other, the other end of the spring member is elastically deformed.

The spring operating portion may include a spring connection portion formed at an upper end portion of the first link arm positioned above the rotating shaft. Further, when the operating arms approach each other, the first link arm may be rotated to press the spring member whose other end is connected to the spring connection portion.

The spring member may be formed of a plate-shaped spring of which one end is fixed to the spring fixing portion and the other end extends above the rotating shaft, the spring operating portion may include a contact surface of an upper end portion of the first link arm, which comes in contact with the other end of the plate-shaped spring above the rotating shaft, and when the first link arm is rotated by movement of the operating arms toward each other, the upper end portion may be rotated together to bend the plate-shaped spring.

The spring member may include a compression spring installed between the two operating arms. One end of the compression spring may be rotatably fixed to the first operating arm, and the other end thereof may be fixed to the second operating arm such that the fixed position of the other end can be adjusted in the longitudinal direction of the second operating arm.

Alternatively, the handgrip may further include a body portion that is provided at the top of the first operating arm and has a spring member installation space formed therein. The body portion may include a spring fixing portion which is provided on an end of the spring member installation space at the first operating arm and to which one end of the spring member is fixed; and a spring operating portion which is slidably installed inside the spring member installation space and has a spring connection portion to which the other end of the spring member is fixed so as to be opposite to the spring fixing portion, both ends of the spring member may be fixed to the spring fixing portion and the spring connection portion, respectively, and an upper end portion of the first link arm extends above a rotating shaft as a connection portion between the first link arm and the first operating arm, and comes in contact with a side surface of the spring operating portion at the first operating arm, thereby pressing the spring operating portion.

The spring operating portion may be connected to a shaft-shaped guide member extending through a through-hole formed in an end of the body portion at the second operating arm, and may include a support roller installed above the through-hole through which the guide member passes.

Alternatively, the handgrip may further include a body portion that is provided at the top of the first operating arm. The body portion may include a sidewall which supports one end of the spring member; a guide member which passes through the sidewall of the body portion so as to extend in the longitudinal direction of the body portion; a spring support portion which is fixed to an end of the guide member at the first operating arm and supports the other end of the spring member such that the spring member is interposed between the sidewall and the spring support portion; and a spring operating portion which is installed in a space positioned at a side surface of the sidewall facing the installation position of the spring member, and coupled to the guide member so as to be moved together with the spring support portion. An upper end portion of the first link arm may extend above a rotating shaft as a connection portion between the first operating arm and the first link arm, and may come in contact with a side surface of the spring operating portion at the first operating arm, thereby pressing the spring operating portion.

The spring operating portion may be formed of a nut-shaped member fixed to the guide member through a screw coupling method, and the position thereof may be adjusted while the spring operating portion is moved along the guide member.

The guide member may extend through a through-hole formed at the end of the body portion to the outside, an elastic force adjusting screw may be coupled to an end of the guide member extending through the through-hole so as to move along the guide member, and the position of the elastic force adjusting screw may be supported by the body portion in a state in which the two operating arms are released. The intensity of the elastic force may be adjusted by adjusting a distance between the spring support portion and the sidewall through the elastic force adjusting screw.

The elastic force adjusting screw may have an opening passing through an outer surface thereof, through which the position of the guide member is checked. Therefore, it is possible to check the intensity of the elastic force.

The body portion may further include a grip indication unit which indicates a grip force required for the deformation of the spring member to correspond to the compressive deformation length of the spring member when the spring support portion is moved. The grip indication unit may include a rack gear which is installed in such a manner that the movement of the rack gear is guided through a guide groove formed above the spring member, and of which an end is supported by the spring support portion such that when the spring support portion is moved to compress the spring member, the rack gear is moved together; a rotating needle which has a pinion gear coupled to the rack gear; and a scale portion on which a grip force is marked.

Advantageous Effects

According to the present invention, it is possible to provide a handgrip in which the movement of two operating arms is not a rotational movement about a hinge point, but a translational opening and closing movement in which the two operating arms remain parallel. Therefore, a force is uniformly distributed across the palm of a user's hand during strength training.

Further, since the spring member for providing an elastic force is installed outside the operating arms, not between the operating arms, the structure of the handgrip can be simplified. Therefore, it is possible to easily install a spring member having a large size and a strong elastic force. Further, when a coil-type compression spring is applied as the spring member, an additional compression spring can be installed inside the compression spring. Therefore, it is possible to easily provide a handgrip which provides a stronger elastic force.

Furthermore, it is possible to provide a handgrip in which the intensity of an elastic force and the distance between the two operating arms can be easily adjusted.

BRIEF DESCRIPTION OF THE DRAWINGS

FIG. 1 is a cross-sectional view for explaining a link structure of a handgrip according to the present invention.

FIG. 2 is a cross-sectional view for explaining the link structure of the handgrip according to the present invention.

FIG. 3 is a cross-sectional view of a handgrip according to an exemplary embodiment of the present invention.

FIG. 4 is a cross-sectional view of the handgrip shown in FIG. 4, showing operation of the handgrip.

FIG. 5 is a cross-sectional view of a handgrip according to another exemplary embodiment of the present invention, FIG. 6 is a cross-sectional view of the handgrip shown in FIG. 5, showing operation of the handgrip.

FIG. 7 is a cross-sectional view of a handgrip according to still another exemplary embodiment of the present invention, FIG. 8 is a cross-sectional view of the handgrip shown in FIG. 7, showing operation of the handgrip.

FIG. 9 is a cross-sectional view of a handgrip according to still another exemplary embodiment of the present invention, FIG. 10 is a cross-sectional view of the handgrip shown in FIG. 9, showing operation of the handgrip.

FIG. 11 is a cross-sectional view of a modification of the handgrip shown in FIG. 9.

FIG. 12 is a cross-sectional view of a handgrip according to still another exemplary embodiment of the present invention.

FIG. 13 is a perspective view of a handgrip according to still another exemplary embodiment of the present invention.

FIG. 14 is a cross-sectional view of the handgrip shown in FIG. 13.

FIGS. 15 to 17 are cross-sectional views of the handgrip shown in FIG. 13, showing operation of the handgrip.

FIG. 18 is a cross-sectional view of a handgrip according to still another exemplary embodiment of the present invention.

FIG. 19 is a cross-sectional view of a handgrip according to still another exemplary embodiment of the present invention.

FIGS. 20 to 22 are cross-sectional views of the handgrip shown in FIG. 19, showing operation of the handgrip.

MODE FOR THE INVENTION

Hereinafter, exemplary embodiments of the present invention will be described in detail with reference to the accompanying drawings. The directions left and right in the following description refer to directions in the accompanying drawings.

FIGS. 1 and 2 are cross-sectional views for explaining a link structure of a handgrip according to the present invention.

Referring to FIGS. 1 and 2, the handgrip according to the present invention includes first and second operating arms 11 and 12 connected to each other through two link arms 52 and 58.

The first and second operating arms 11 and 12 are spaced apart from each other by a distance that enables a user to grip the handgrip in one hand. Between the operating arms 11 and 12, the first and second link arms 52 and 58 are connected.

The first and second link arms 52 and 58 are sequentially and obliquely disposed between the first and second operating arms 11 and 12. Both ends of the link arms 52 and 58 are rotatably connected to the first and second operating arms 11 and 12, respectively, through rotating shafts. Therefore, when a user grips the first and second operating arms 11 and 12 in one hand and squeezes, the two operating arms 11 and 12 approach each other while remaining parallel, as shown in FIG. 2. When the squeezing is stopped, the two operating arms 11 and 12 recede from each other while remaining parallel.

According to the handgrip constructed in such a manner, the operating arms 11 and 12 approach and recede from each other while remaining parallel, when a user performs strength training. Therefore, force applied by the operating arms 11 and 12 is uniformly distributed across the palm of the user's hand.

FIG. 3 is a diagram showing a handgrip according to an exemplary embodiment of the present invention.

Referring to FIG. 3, the handgrip according to this exemplary embodiment includes a body portion 20 having a spring member 40 installed at the top of a first operating arm 11. As the spring member 40, a coil-type tension spring 41 is provided. The tension spring 41 provides an elastic force to two operating arms 11 and 12 by being tensioned when the operating arms 11 and 12 approach each other.

The body portion 20 has a pin-shaped spring fixing portion 60 formed therein, to which one end of the tension spring 41 is fixed.

The other end of the tension spring 41 is supported by a spring operating portion. The spring operating portion is installed in such a manner that the tension spring 41 is deformed by the movement of the spring operating portion. Further, the spring operating portion is operationally connected to a first link arm 52. The spring operating portion is involved in an operation of displacing one end of the spring member with respect to the other end of the spring member such that the spring member is deformed.

Referring to FIG. 3, the spring operating portion will be described in detail. The spring operating portion includes a spring connection portion 56 formed at an upper end portion 55 of the first link arm 52.

The first link arm 52 extends upward through a rotating shaft 14 as a connection portion between the first link arm 52 and the first operating arm 11, and a locking-groove-shaped spring connection portion 56 is provided at the upper end portion 55 of the first link arm 52 extending upward. The other end of the tension spring 41 is locked and fixed to the spring connection portion 56. Therefore, when the spring connection portion 56 is moved to the left, the tension spring 41 generates an elastic force while being tensioned. The spring connection portion 56 may be formed in a pin shape, as shown in FIG. 4.

Referring to FIG. 4, operation of the handgrip shown in FIG. 3 will be described.

When a user grips the first and second operating arms 11 and 12 and then squeezes, the operating arms 11 and 12 approach each other while remaining parallel. At this time, the upper end portion 55 of the first link arm 52 is rotated counterclockwise about the rotating shaft 14, and the spring connection portion 56 pulls the tension spring 41 fixed to the spring fixing portion 60 whose one end is formed in a pin shape, thereby deforming the tension spring 41. Then, an elastic force is generated by the tension spring 41 and provided between the two operating arms 11 and 12.

FIGS. 5 and 6 are diagrams showing a handgrip according to another exemplary embodiment of the present invention.

The handgrip shown in FIGS. 5 and 6 is different from the handgrip shown in FIGS. 3 and 4 in that a plate-shaped spring 43 is used as the spring member 40, and the spring connection portion 56 is formed in a fixed pin shape. All other structural elements are the same as those of the handgrip shown in FIGS. 3 and 4. Therefore, when a user grips the two operating arms 11 and 12 and squeezes, the operating arms 11 and 12 approach each other while remaining parallel. At this time, while the spring connection portion 56 formed at the upper end portion 55 of the first link arm 52 is rotated counterclockwise about the rotating shaft 14, the spring connection portion 56 pulls the plate-shaped spring 43, thereby deforming the plate-shaped spring 43. An elastic force generated at this time biases the operating arms 11 and 12 apart from each other. A user performs strength training while overcoming the elastic force.

FIGS. 7 and 8 are diagrams showing a handgrip according to another exemplary embodiment of the present invention. FIGS. 7 and 8 show a modification of the handgrip which uses a plate-shaped spring 43 as the spring member.

One end of the plate-shaped spring 43 is fixed to a groove-shaped spring fixing portion 60 within the body portion 20.

The other end of the plate-shaped spring 43 extends above a rotating shaft 14 and comes in contact with the upper end portion 55 of the first link arm 52 composing the spring operation portion. A contact surface 57 of the upper end portion 55 of the first link arm 52 comes in surface contact with the plate-shaped spring 43. When the first link arm 52 is rotated, the contact surface of the upper end portion 55 is rotated to push the plate-shaped spring 43 upward.

When the two operating arms 11 and 12 approach each other in a state shown in FIG. 7, the first link arm 52 is rotated about the rotating shaft 14 such that the upper end portion 55 presses the other end of the plate-shaped spring 43, thereby bending the plate-shaped spring 43. Then, an elastic force generated when the plate-shaped spring 43 is bent is provided to the operating arms 11 and 12.

FIG. 9 is a diagram showing a handgrip according to still another exemplary embodiment of the present invention.

According to the exemplary embodiment shown in FIG. 9, a compression spring 42 serving as the spring member 40 is installed between the two operating arms.

One end of the compression spring 42 is rotatably fixed to a lower end of the first operating arm 11, and the compression spring 42 extends in a direction crossing the inclination direction of link arms 52 and 58 such that the other end thereof is rotatably fixed to the second operating arm 12. At this time, the other end of the compression spring 42 may be installed on the second operating arm 12 such that the fixed position thereof can be adjusted in the longitudinal direction of the second operating arm 12.

An elastic force adjusting portion 13, by which the fixed position of the other end of the compression spring 42 can be adjusted, includes a plurality of fixing grooves 13*a* to 13*c* to which the other end of the compression spring 42 can be fixed. The other end of the compression spring 42 is received on the first, second, or third fixing groove 13*a*, 13*b*, or 13*c*, and the elastic force of the compression spring 42 is adjusted depending on the position thereof. When the other end of the compression spring 42 is inserted and fixed to the first fixing groove 13*a*, a larger elastic force can be provided than when the other end of the compression spring 42 is inserted and fixed to the third fixing groove 13*c*. This is because, when the other end of the compression spring 42 is inserted and fixed to the first fixing groove 13*a*, the amount of compressive deformation of the compression spring 42 generated by movement of the operating arms 11 and 12 toward each other is larger than when the other end of the compression spring 42 is inserted and fixed to the third fixing groove 13*c*.

According to the present invention, the spring member 40 includes a guide 70 which guides deformation of the compression spring 42. Referring to FIG. 9, the guide 70 includes first and second guides 72 and 75, and the compression spring 42 is interposed between the first and second guides 72 and 75. The first guide 72 supports one end of the compressing spring 42 and is rotatably fixed to the lower end of the first operating arm 11. A shaft 73 of the first guide 72 is formed of a hollow shaft and extends to the inside of the compression spring 42. The second guide 75 corresponding to the first guide 72 supports the other end of the compression spring 42 and has a hemispherical end portion which is received on the fixing groove 13*a*, 13*b*, or 13*c*. A shaft 76 of the second guide 75 extends through the inside of the compression spring 42 into a hollow portion 74 of the shaft 73 of the first guide 72. When the compression spring 42 is compressed by movement of the operating arms 11 and 12 toward each other, the shaft 76 of the second guide 75 is slid along the hollow portion 74 of the shaft 73 of the first guide 72. The guide 70 guides deformation of the compression spring 42, thereby preventing the compression spring 42 from being bent in an outer direction of the operating arms 11 and 12.

According to the present invention, the elastic force adjusting portion 13 may include a plurality of fixing protrusions 13*d* to 13*f*, instead of the fixing grooves 13*a* to 13*c*. FIG. 10 is a diagram showing a modification of the hand grip shown in FIG. 9, in which the elastic force adjusting portion 13 is composed of the fixing protrusions 13*d* to 13*f*. All other structural elements are the same as those of the hand grip shown in FIG. 9. As shown in FIG. 10, when the elastic force adjusting portion 13 is composed of the fixing protrusions 13*d* to 13*f*, the second guide 75 is formed to have a hemispherical groove corresponding to the shape of the fixing protrusions 13*d* to 13*f*.

According to this exemplary embodiment of the present invention, the compression spring 42 installed between the two operating arms may be installed without the elastic force adjusting portion provided therein, as shown in FIG. 12.

FIG. 11 is a diagram showing a handgrip according to still another exemplary embodiment of the present invention, illustrating a modification of the elastic force adjusting portion.

Referring to FIG. 11, the elastic force adjusting portion 13 includes a shaft 15 extending in the longitudinal direction of a second operating arm 12, an adjustment knob for rotating the shaft 15, and a nut-shaped member 17 which is coupled to the shaft 15 so as to be lifted or lowered by rotation of the adjustment knob 16. The other end of the compression spring 42 is rotatably connected to the nut-shaped member 17 and lifted or lowered by rotation of the adjustment knob 16. While the adjustment knob 16 is rotated, the nut-shaped member 17 is lifted or lowered along the shaft 15. Accordingly, the deformation amount of the compression spring 42 when the two operating arms 11 and 12 approach each other is adjusted in such a manner that the intensity of an elastic force applied between the operating arms 11 and 12 is adjusted.

FIG. 12 is a diagram showing a handgrip according to still another exemplary embodiment of the present invention. In the handgrip shown in FIG. 12, both the tension spring 41 and the compression spring 42 are provided as the spring member.

According to the exemplary embodiment shown in FIG. 12, the compression spring 42 does not include an elastic force adjusting portion. Therefore, the hemispherical end portion of the second guide 75 is received on one hemispherical groove 13*g* formed in the second operating arm 12 so as to be rotatably supported. As described above, however, the position of the other end of the compression spring 42 may be adjusted in such a manner that the intensity of the elastic force can be adjusted.

FIG. 13 is a perspective view of a handgrip according to still another exemplary embodiment of the present invention. FIG. 14 is a cross-sectional view of the handgrip shown in FIG. 13.

Referring to the drawings, the first and second operating arms 11 and 12 are spaced at such a distance from each other that a user can grip the first and second operating arms 11 and 12 with one hand. The operating arms 11 and 12 are connected to each other through the first and second link arms 52 and 58, which are sequentially and obliquely disposed between the operating arms 11 and 12.

According to this exemplary embodiment of the present invention, the body portion 20 is formed at the top of the operating arm 11 and has the spring member 40 installed along the longitudinal direction thereof. In such a construction, the spring member 40 providing an elastic force is positioned outside of the operating arms 11 and 12, or specifically, above the first operating arm 11, not between the two operating arms 11 and 12. Therefore, the spring member 40 is easily installed and the handgrip can be designed to mount spring members having a variety of sizes and strengths. Further, since the spring member 40 is installed so as to be deformed in the longitudinal direction thereof along the installation direction, the spring member 40 can be operated more stably. In such a construction, a spring member having a large size and a strong elastic force can be adopted as the spring member of the handgrip.

Meanwhile, as shown in FIG. 12, the handgrip may be designed to have an additional spring member provided between the two operating arms 11 and 12.

Returning to FIGS. 13 and 14, the body portion 20 formed at the top of the first operating arm 11 has a sidewall 23 provided therein. A space 24 is provided in the left side of the sidewall 23. A spring installation portion in which the spring member is to be installed is provided in the right side of the sidewall 23. Therefore, one end of the spring member 40 is supported by the right surface of the sidewall 23, and the other end thereof can be operationally supported by a spring support portion 26 which will be described below.

The spring member 40 is installed in the longitudinal direction of the body portion 20 and interposed between the sidewall 23 and the spring support portion 26 so as to be deformed. In such a construction, the deformation of the spring member 40 is performed in the longitudinal direction thereof. In the conventional handgrip in which two operating arms are connected through a hinge pin and a spring member is installed between the operating arms, a structure is needed to rotatably support both ends of the spring member such that the spring member is not bent outward when the operating arms approach each other. In this exemplary embodiment, however, since the spring member is deformed only in the longitudinal direction thereof, it is possible to support both ends of the spring member through the simpler structure.

According to this exemplary embodiment of the present invention, a shaft-shaped guide member 25 is provided so as to extend in the longitudinal direction thereof through the sidewall 23 of the body portion 20. The guide member 25 extends through the spring member 409 to the right side, and has a washer-shaped spring support portion 26 provided at an end thereof, the spring support portion 26 supporting the other end of the spring member 40.

According to this exemplary embodiment of the present invention, the spring member 40 includes a compression spring 44. The spring member 40 may include an additional compression spring within the compression spring 44.

When the spring support portion 26 is moved toward the sidewall 23 by the guide member 25, the spring member 40 is compressed. Therefore, the spring support portion 26 serves as a spring pressing portion which presses the compression spring 44, and the sidewall 23 serves as a spring fixing portion.

The guide member 25 is installed so as to move through the sidewall 23 of the body portion 20. A disk-shaped spring operating portion 30 is disposed in the space 24 positioned in the left side of the sidewall 23, that is, in a sideways direction opposite to the installation position of the compression spring 44, and is coupled to the guide member 25. Therefore, when the spring operating portion 30 is moved to the left, the compression spring 44 interposed between the sidewall 23 and the spring support portion 26 is compressed while the guide member 25 and the spring support portion 26 coupled to the end of the guide member 25 are moved together to the left.

The spring operating portion 30 may be formed of a nut-shaped member which is fixed to the guide member 25 through a screw coupling method. The guide member 25 has a screw thread 27 formed on the outer circumferential surface thereof, and a nut hole having a screw thread formed therein is formed in the center of the spring operating portion 30. Therefore, the guide member 25 and the spring operating portion 30 are coupled to each other through a screw coupling method. Accordingly, while the spring operating portion 30 is moved along the guide member 25 by rotation of the spring operating portion 30, the position of the spring operating portion 30 can be adjusted.

According to this exemplary embodiment of the present invention, the spring operating portion 30 is operationally connected to the first link arm 52. The spring operating portion 30 is operationally connected to the other end of the compression spring 44 by the guide member 25 and the spring support portion 26. Therefore, the first link arm 52 is operationally connected to the other end of the compression spring 44 through the connection relationship among the spring operating portion 30, the guide member 25, and the spring support portion 26.

The first link arm 52 extends above the rotating shaft 14 as a connection portion between the first operating arm 11 and the first link arm 52, and the upper end portion 55 of the first link arm 52 extends toward the lower end of the sidewall 23 so as to come in contact with the right side surface of the spring operating portion 30. Therefore, the upper end portion 55 of the first link arm 52 can push up the spring operating portion 30. The first link arm 52 may have a separate auxiliary contact member such as a roller formed at the upper end portion 55 thereof. The counter-clockwise rotation of the first link member 55 about the rotating shaft 14 is transmitted to the spring operating portion 30 through the contact surface of the upper end portion 55, thereby moving the spring operating portion 30 to the left. When the two operating arms 11 and 12 are released, the spring operating portion 30 returns to the original position due to a recovery force of the compression spring 44, thereby pushing the upper end portion 55 to the left. Through such a principle, the opening and closing movement of the two operating arms 11 and 12 is connected to the compression and recovery movement of the compression spring 44.

Since the two operating arms 11 and 12 are connected through the first and second link arms 52 and 58, the operating arms 11 and 12 approach and recede from each other while remaining parallel. This cannot be expected in the conventional handgrip, and such a change in the movement of the operating arms 11 and 12 can enhance a feeling of training. Further, when a user performs grip strength training, a force can be uniformly transmitted across the fingers or palm of the user's hand.

According to this exemplary embodiment of the present invention, the handgrip is constructed so as to adjust the intensity of the elastic force provided by the spring member 40 and a distance between the operating arms.

Further, the guide member 25 is formed in an elongated bolt type having the screw thread 27 formed on the outer circumferential surface thereof, and the spring operating portion 30 is coupled to the guide member 25 through a screw coupling method such that the position thereof can be adjusted in the longitudinal direction of the guide member 25. Therefore, the position of the spring operating portion 30 on the guide member 25 can be adjusted by rotation of the spring operating portion 30.

Since the spring operating portion 30 is operationally connected to the second operating arm 12 through the first link arm 52, the position adjustment of the spring operating portion 30 has an effect upon the distance between the first and second operating arms 11 and 12. That is, the distance between the first and second operating arms 11 and 12 is adjusted. For example, when the spring operating portion 30 is moved to the left, the upper end portion 55 of the first link arm 52 is rotated counter-clockwise about the rotating shaft 14 so as to come in contact with the spring operating portion 30. Therefore, the position of the second operating arm 12 is adjusted in a direction from which the second operating arm 12 approaches the first operating arm 11.

Meanwhile, the guide member 25 extends through a through hole 21 formed at the right end of the body portion 20 to the outside, and an elastic force adjusting screw 35 is coupled to the extending end of the guide member 25. The elastic force adjusting screw 35 is coupled to the guide member 25 through a screw coupling method such that the position thereof can be adjusted along the guide member 25.

In a release state in which no force is applied to the two operating arms 11 and 12, that is, when the operating arms 11 and 12 are not squeezed, the elastic force adjusting screw 35 comes in contact with the body portion 22 such that the position thereof is supported. Since the elastic force adjusting screw 35 comes in contact with the body portion 20 in a state in which it is fixed to the guide member 25, the elastic force adjusting screw 35 is involved in a displacement to the right of the guide member 25.

Therefore, when the guide member 25 is moved to the left with respect to the elastic force adjusting screw 35 by adjusting the elastic force adjusting screw 35, the spring support portion 26 is moved to the left such that a distance between the spring support portion 26 and the sidewall 23 of the body portion 20 decreases. In the release state in which the operating arms are not squeezed, the distance between the spring support portion 26 and the sidewall 23 is equal to the length of the compression spring 44.

The intensity of an elastic force provided when the operating arms 11 and 12 approach each other is determined by the compression deformation of the spring member 40. Therefore, when the distance between the spring support portion 26 and the sidewall 23 is reduced in such a manner that the compression spring 44 is maintained in a deformed state, a force exceeding the force generated by the deformed compression spring 44 is needed to deform the compression spring 44 from the release state by applying a force to the operating arms 11 and 12. Therefore, the force required to squeeze the operating arms 11 and 12 together increases. Since the elastic force adjusting screw 35 can adjust the position of the spring support portion 26 in the release state, the intensity of the force required to squeeze the operating arms 11 and 12 together from the release state can be adjusted. As such, adjustment of the force required to squeeze the operating arms 11 and 12 together is referred to as adjustment of the strength or elastic force of the handgrip.

In the handgrip according to this exemplary embodiment of the present invention, the elastic force adjusting screw 35 and the spring operating portion 30 can be rotated to adjust the intensity of an elastic force and the distance between the operating arms 11 and 12 according to a user s strength and hand size.

According to the present invention, the elastic force adjusting screw 35 includes an opening 36 passing through an outer surface thereof. The opening 36 is a window through which the inside of the elastic force adjusting screw 35 is seen, and the position of the guide member 25 adjusted by the elastic force adjusting screw 35 can be grasped through the opening 36. The position of the guide member 25 with respect to the elastic force adjusting screw 35 is associated with the intensity of an elastic force. Therefore, when scales 37 are marked around the opening 36, the intensity of an adjusted elastic force can be more clearly recognized from a scale corresponding to a reference point of the guide member 25 (for example, an end position or a line marked on the outer circumferential surface of the guide member).

According to the present invention, a support roller 32 for supporting the movement of the guide member 25 is installed at an end portion of the body portion 20 so as to be disposed above the through-hole 21. The spring operating portion 30 comes in contact with the upper end portion 55 of the first link arm 52 so as to receive force applied by a user squeezing the operating arms 11 and 12. Since the contact position is under the center point of the spring operating portion 30, a moment acts about the center point of the spring operating portion 30. In this case, the acting moment may cause the guide member 25 to come in contact with the inner surface of the through-hole 21 and damage the body portion 20. Therefore, the support roller 32 is installed to offset the acting moment. The longitudinal movement of the guide member 25 is guided by the support roller 32, thereby making it possible to prevent the guide member 25 from damaging the body portion 20. When the guide member 25 has a screw thread formed on the outer circumferential surface thereof, a screw thread corresponding to that of the guide member 25 is also formed on the outer circumferential surface of the support roller 32 such that the screw threads are not damaged.

Referring to FIGS. 13 to 17, operation of the handgrip will be described in detail.

Comparing FIG. 14 with FIG. 15, FIG. 14 shows a state in which the two operating arms 11 and 12 are released, and FIG. 15 shows a state in which a user grips and squeezes the operating arms 11 and 12 together.

As shown in FIG. 15, when the two operating arms 11 and 12 approach each other from the state of FIG. 14, the contact surface of the upper end portion 55 of the first link arm 52 presses the spring operating portion 30 such that the spring operating portion 30 is moved to the left. Further, the guide member 25 coupled to the spring operating portion 30 is moved to the left together with the spring support portion 26. Therefore, the compression spring 44 interposed between the sidewall 23 of the body portion 20 and the spring support portion 26 is compressed to provide an elastic force.

According to this exemplary embodiment of the present invention, the spring member 40 may be composed of two coil-type compression springs. That is, an additional coil-type compression spring may be installed inside one coil-type compression spring 44 between the sidewall 23 of the body portion 20 and the spring support portion 26. Therefore, according to this exemplary embodiment, it is possible to provide a handgrip which provides a large elastic force by increasing the number of spring members, without changing the structure or shape of the handgrip. Accordingly, the handgrip can be provided in various types corresponding to the muscular strength of a variety of users, including athletes, non-athletes, and children.

FIG. 16 shows a state in which the intensity of an elastic force is adjusted to increase in comparison with the state of FIG. 14. When the elastic force adjusting screw 35 is rotated to move the position of the spring support portion 26 in the release state to the left, the length of the compression spring 44 in the release state decreases. The decrease in the length of the compression spring 44 means that the deformed state of the compression spring 44 is maintained even in the release state. Therefore, a force required to squeeze the two operating arms 11 and 12 together increases in comparison with the case shown in FIG. 14.

The adjusted position of the guide member 25 can be checked through the opening 36. The intensity of the adjusted elastic force can be numerically checked through the reference point corresponding to the scale 37. Comparing FIG. 14 with FIG. 16, it can be seen that a user can check the adjusted state of the elastic force while the end position of the guide member 25 is seen with the naked eye. Further, a variety of reference points may be associated with the scale 37, not just the end position of the guide member 25.

Now, a process of adjusting the intensity of an elastic force by adjusting the elastic force adjusting screw 35 will be described. As shown in FIG. 15, the adjustment process is performed in a state in which the two operating arms 11 and 12 are squeezed together. In the state shown in FIG. 15, the elastic force adjusting screw 35 can be easily manipulated because a force is not applied to the elastic force adjusting screw 35. After the elastic force adjusting screw 35 is adjusted, the force applied to the operating arms 11 and 12 is removed to release the operating arms 11 and 12. When a user moves the guide member 25 to the left with respect to the elastic force adjusting screw 35, the spring operating portion 30 coupled to the guide member 25 is moved together to the left. Therefore, the distance between the operating arms 11 and 12 decreases. Therefore, to keep the distance between the operating arms 11 and 12 constant, the spring operating portion 30 needs to be rotated and moved to the right such that the distance between the operating arms 11 and 12 increases. Through the adjustment process, the distance between the two operating arms and the intensity of the elastic force can be easily adjusted as desired.

Comparing FIG. 15 with FIG. 17, when the two operating arms 11 and 12 are fully closed by squeezing them together, the length of the compression spring 44 in a state of FIG. 17 in which the intensity of an elastic force is increased by adjusting the elastic force adjusting screw 35 is smaller than in the state of FIG. 15. Therefore, it can be found that the force required to squeeze the operating arms 11 and 12 together from the state of FIG. 16 is larger than from the state of FIG. 14.

FIG. 18 is a diagram showing a handgrip according to still another exemplary embodiment of the present invention. The handgrip according to the exemplary embodiment shown in FIG. 15 includes a tension spring 41 as the spring member 40.

The body portion 20 includes a space 24-1 which is open on at least one side and in which the spring member is to be installed, and the spring fixing portion 60 to which one end of the tension spring 41 is fixed is provided at the open end of the spring member installation space 24-1. The spring fixing portion 60 is formed of an end cap 61 having a spring fixing ring 62 provided thereon. Related parts are first installed in the spring member installation space 24-1, and the end cap 61 is then coupled.

The spring operating portion 30 is slidably installed in the space 24-1 of the body portion 20. A spring connection portion 33 is provided on a side surface of the spring operating portion 30, the side surface facing the spring fixing portion 60. The upper end portion 55 of the first link arm 52 comes in contact with the side surface of the spring operating portion 30.

The spring operating portion 30 has a guide protrusion 31 formed on each of the upper and lower surfaces thereof so as to slide in the space 24-1. The body portion 20 has a guide channel 22 formed on each of the top and bottom surfaces of the space 24-1 of the body portion 20, the guide channel 22 corresponding to the guide protrusion 31.

The tension spring 41 is installed between the spring fixing portion 60 and the spring operating portion 33 in a state in which both ends of the tension spring 41 are coupled to the spring fixing ring 62 and the spring connection portion 33, respectively.

According to the present invention, the guide member 25-1 is connected to the other side surface of the spring operating portion 30, that is, a side surface opposed to the installation position of the spring member 40 so as to extend through the through-hole 21 formed at an end portion of the body portion 20. The support roller 32 is installed within the end portion of the body portion 20 so as to be disposed above the through-hole 21 in the upward direction of the guide member. The function of the support roller 32 has been described above.

Operation of the handgrip shown in FIG. 18 will be described. When a user grips the two operating arms 11 and 12 and then squeezes, the first and second link arms 52 and 58 are operated in such a manner that the operating arms 11 and 12 approach each other while remaining parallel. At this time, the upper end portion 55 of the first link arm 52 pushes the spring operating portion 30 to the left. Accordingly, the spring operating portion 30 pulls one end of the tension spring 41 to generate an elastic force which is then provided to the operating arms 11 and 12. While overcoming the force, a user continuously squeezes and releases, thereby strengthening his/her grip.

FIGS. 19 to 22 are diagrams showing a handgrip including a grip indication unit 80 according to still another exemplary embodiment of the present invention. In this exemplary embodiment of the present invention, a force applied to the handgrip by a user can be checked through the grip indication unit 80 provided in the handgrip.

The grip indication unit 80 includes a rotating needle 84 which rotates to correspond to the deformation length of the compression spring 44 and a scale portion 85 on which a grip force corresponding to the position of the rotating needle 84 is marked.

Referring to FIG. 19, the body portion 20 has a guide groove 81 formed above the compression spring 44, and a rack gear 82 is slidably installed in the guide groove 81. One end portion of the rack gear 82 is supported by the spring support portion 26 in a state in which it comes in contact with the spring support portion 26. Therefore, when the spring support portion 26 is moved in the compression direction of the compression spring, the rack gear 82 is moved together.

The rotating needle 84, which is rotated along with movement of the rack gear 82, includes a pinion gear 83 which is provided at an end thereof so as to be geared with the rack gear 82. Therefore, while the pinion gear 83 supported by a rotating shaft is rotated by movement of the rack gear 82, the rotating needle 84 is rotated. The scale portion 85 has scales marked on a semi-circular surface, like a goniometer. Therefore, a grip force applied to the handgrip by a user can be measured on a scale using the rotating needle 84.

The operation of the grip indication unit 80 will be described in more detail with reference to FIGS. 19 and 20. In the state of FIG. 19, the two operating arms 11 and 12 are released so as to be separated from each other.

In this state, when a user grips the two operating arms 11 and 12 with one hand and then squeezes, the operating arms 11 and 12 approach each other while the compression spring 44 is compressed. As the operating arms 11 and 12 approach each other, the spring support portion 26 moves so as to compress the compression spring 44, and the rack gear 82 moves together with the spring support portion 26. The movement of the rack gear 82 corresponds to the displacement of the spring support portion 26 and the deformation of the compression spring 44 caused by the displacement of the spring support portion 26. The movement of the rack gear 82 rotates the pinion gear 83. Therefore, as shown in FIG. 19, the grip force applied to the operating arms 11 and 12 by the user can be indicated on a scale by the rotating needle 84.

The rack gear 82 may be installed in such a manner that the rack gear 82 and the spring support portion 26 are not attached but simply come in contact with each other. Therefore, even when the compression spring 44 is restored by releasing the two operating arms 11 and 12 and the spring support portion 26 is moved to the right, the rack gear 82 and the rotating needle 84 are maintained at the moved positions. Therefore, even when the two operating arms 11 and 12 are released in the state of FIG. 20, the grip force applied to the operating arms 11 and 12 by the user can be measured.

To return the rotating needle 84 to a position of 0, the user rotates the rotating needle 84 in the counterclockwise direction. Accordingly, the pinion gear 83 is rotated to move the rack gear 82 in the right direction. Then, the rack gear 82 is moved to a position where it comes in contact with the spring contact portion 26.

Meanwhile, the case in which the intensity of the elastic force provided by the handgrip is increased by adjusting the elastic force adjusting screw 35 will be described with reference to FIG. 21. When the position of the spring support portion 26 is moved toward the left side in comparison with the state of FIG. 19 in a state in which the two operating arms 11 and 12 are released, the rotating needle 84 points on the scale to a grip force which is initially set in the handgrip. That is, when a user does not apply more than the initially-set grip force, the operating arms 11 and 12 do not move. On the other hand, when a user squeezes harder than the grip force indicated by the rotating needle 84, the operating arms 11 and 12 approach each other, and the force applied to the operating arms 11 and 12 can be checked through the grip indication unit 80, as shown in FIG. 22. Comparing FIG. 19 with FIG. 21, it can be also seen that a grip force required to squeeze the operating arms 11 and 12 together completely can be adjusted by the elastic force adjusting screw 35.

In the above description of exemplary embodiments of the present invention, components that are common to different exemplary embodiments have only been described once for concision. While a few exemplary embodiments of the present invention have been shown and described, it will be appreciated by those skilled in the art that various changes may be made to these embodiments without departing from the spirit and scope of the invention as defined by the appended claims and their equivalents.

The invention claimed is:

1. A handgrip comprising:

first and second operating arms that are spaced apart from each other;

first and second link arms that are sequentially and obliquely disposed between the first and second operating arms, and of which both ends are rotatably connected to the operating arms, respectively, through rotating shafts;

a spring member that is installed to provide an elastic force biasing the first and second operating arms apart from each other;

a body portion that is provided at the top of the first operating arm, wherein the body portion includes:

a sidewall which supports one end of the spring member;

a guide member which passes through the sidewall of the body portion so as to extend in the longitudinal direction of the body portion;

a spring support portion which is fixed to an end of the guide member at the first operating arm and supports the other end of the spring member such that the spring member is interposed between the sidewall and the spring support portion; and a spring operating portion which is installed in a space positioned at a side surface of the sidewall facing the installation position of the spring member, and coupled to the guide member so as to be moved together with the spring support portion, and an upper end portion of the first link arm extends above a rotating shaft as a connection portion between the first operating arm and the first link arm, and comes in contact with a side surface of the spring operating portion at the first operating arm, thereby pressing the spring operating portion.

2. The handgrip according to claim 1, wherein the spring operating portion is formed of a nut-shaped member fixed to the guide member through a screw coupling method, and the position thereof is adjusted while the spring operating portion is moved along the guide member.

3. The handgrip according to claim 1, wherein the guide member extends through a through-hole formed at the end of the body portion to the outside, an elastic force adjusting screw is coupled to an end of the guide member extending through the through-hole so as to move along the guide member, the position of the elastic force adjusting screw is supported by the body portion in a state in which the two operating arms are released, and a distance between the spring support portion and the sidewall is adjusted by the elastic force adjusting screw.

4. The handgrip according to claim 3, wherein a support roller for supporting the guide member is installed at the end of the body portion so as to be disposed above the through-hole.

5. The handgrip according to claim 3, wherein the elastic force adjusting screw has an opening passing through an outer surface thereof, through which the position of the guide member is checked.

6. The handgrip according to claim 2, wherein the guide member extends through a through-hole formed at the end of the body portion to the outside, an elastic force adjusting screw is coupled to an end of the guide member extending through the through-hole so as to move along the guide member, the position of the elastic force adjusting screw is supported by the body portion in a state in which the two operating arms are released, and a distance between the spring support portion and the sidewall is adjusted by the elastic force adjusting screw.

7. The handgrip according to claim 6, wherein a support roller for supporting the guide member is installed at the end of the body portion so as to be disposed above the through-hole.

8. The handgrip according to claim 6, wherein the elastic force adjusting screw has an opening passing through an outer surface thereof, through which the position of the guide member is checked.

* * * * *